US012723416B2

(12) United States Patent
Ono et al.

(10) Patent No.: US 12,723,416 B2
(45) Date of Patent: Sep. 1, 2026

(54) HANGING SCAFFOLD AND METHOD FOR ASSEMBLING HANGING SCAFFOLD

(71) Applicant: Dai Ono, Chiba (JP)

(72) Inventors: Dai Ono, Chiba (JP); Tatsuo Kurisu, Yamaguchi (JP)

(73) Assignee: Dai Ono, Chiba (JP)

( * ) Notice: Subject to any disclaimer, the term of this patent is extended or adjusted under 35 U.S.C. 154(b) by 0 days.

(21) Appl. No.: 19/193,977

(22) Filed: Apr. 30, 2025

(65) Prior Publication Data

US 2025/0369238 A1 Dec. 4, 2025

(30) Foreign Application Priority Data

Jun. 4, 2024 (JP) ..... 2024-090878

(51) Int. Cl.

| | |
|---|---|
| ***E04G 3/22*** | (2006.01) |
| ***E04G 5/00*** | (2006.01) |
| ***E04G 7/26*** | (2006.01) |

(52) U.S. Cl.

CPC ..... *E04G 3/22* (2013.01); *E04G 5/007* (2013.01); *E04G 7/26* (2013.01)

(58) Field of Classification Search

CPC ..... E04G 5/007; E04B 2001/2409; A47F 5/0815; A01M 31/02; B60R 2011/0066; F16B 5/0036

See application file for complete search history.

(56) References Cited

U.S. PATENT DOCUMENTS 276,241 A * 4/1883 Hanavan ..... A22C 15/003 248/340
2,057,092 A * 10/1936 Geib ..... G03B 15/02 182/113

(Continued)

FOREIGN PATENT DOCUMENTS

CN 106968376 A * 7/2017 ..... E04B 5/10
CN 105952130 B * 1/2018 ..... E04G 3/22

(Continued)

OTHER PUBLICATIONS

JP-08013788 Translation (1996).*

(Continued)

*Primary Examiner* — Brian D Mattei
*Assistant Examiner* — Kathleen M. McFarland
(74) *Attorney, Agent, or Firm* — Paratus Law Group, PLLC

(57) ABSTRACT

Included is a scaffold body including a plurality of beam members arranged in parallel, a joint connected to end portions of the beam members by a connecting member, and a work floor installed between the beam members, in which the beam member includes a pair of left and right attachment pieces provided at lower ends of the respective end portions of an upper beam material and formed with pin holes, the joint includes a plurality of plates provided in a circumferential direction on an outer periphery of a cylindrical body, the plate includes a recessed portion formed at an upper end; and an insertion hole facing the pin hole in a state of being fitted between the attachment pieces, and the connecting member is a coupling pin inserted into the pin hole and the insertion hole facing each other in a state where the plate is fitted between the attachment pieces.

9 Claims, 12 Drawing Sheets

(56) References Cited

U.S. PATENT DOCUMENTS 2,113,196 A * 4/1938 Jones ..... E04G 7/02 403/173
3,727,362 A * 4/1973 Ellison ..... E04B 5/14 52/645
3,735,951 A * 5/1973 Reed ..... E04G 3/22 248/340
3,945,462 A * 3/1976 Griswold ..... E04G 5/045 248/231.51
4,276,959 A * 7/1981 Barber ..... B63C 5/02 248/323
4,299,509 A * 11/1981 Meickl ..... E04B 1/58 403/174
4,514,940 A * 5/1985 Manderla ..... E04G 11/48 52/646
4,558,968 A * 12/1985 Meickl ..... E04B 1/2604 403/255
4,570,749 A * 2/1986 McKibbin ..... E04G 3/28 182/36
4,577,449 A * 3/1986 Celli ..... F16B 7/048 52/655.1
4,660,680 A * 4/1987 Potin ..... E01D 19/106 182/36
4,749,060 A * 6/1988 Vandelinde ..... E04G 3/30 182/113
4,848,516 A * 7/1989 Nakai ..... E04G 3/22 182/36
5,664,391 A * 9/1997 Bartholomew ..... E04G 21/3261 248/237
5,678,654 A * 10/1997 Uzawa ..... E04G 1/15 182/150
5,911,288 A * 6/1999 Zafirakis ..... E04G 3/22 182/150
6,205,739 B1 * 3/2001 Newlin ..... E04B 1/19 52/645
6,817,444 B1 * 11/2004 Shinas ..... E04G 3/00 14/74
7,357,262 B2 * 4/2008 Fratilla ..... A47B 47/02 211/117
8,123,001 B1 * 2/2012 Apostolopoulos ..... E04G 3/30 182/150
8,511,486 B2 * 8/2013 Mansor ..... A47B 43/00 211/117
9,103,081 B1 * 8/2015 Mangin ..... E04G 3/22
9,410,333 B2 * 8/2016 Grumberg ..... E04G 5/14
9,976,264 B2 * 5/2018 Grumberg ..... E04G 7/28
10,106,992 B2 * 10/2018 Turner ..... E04G 3/30
10,465,396 B2 * 11/2019 Apostolopoulos ..... E04G 3/22
10,883,233 B2 * 1/2021 Grumberg ..... E04G 3/30
10,968,644 B2 * 4/2021 Apostolopoulos ..... E04G 1/152
2011/0262215 A1 * 10/2011 Thacker ..... E04G 7/307 403/81
2014/0345972 A1 * 11/2014 Grumberg ..... E04G 5/145 52/745.05
2014/0345976 A1 * 11/2014 Grumberg ..... E04G 3/22 52/741.1
2016/0002936 A1 * 1/2016 Cox ..... E04G 1/152 403/376
2017/0081865 A1 * 3/2017 Turner ..... E04G 3/30
2018/0135316 A1 * 5/2018 Apostolopoulos ..... E04G 5/165
2018/0327983 A1 * 11/2018 Grumberg ..... E04G 7/28
2020/0123791 A1 * 4/2020 Apostolopoulos ..... E04G 3/22
2022/0213701 A1 * 7/2022 Richards ..... E04G 7/34
2023/0265645 A1 * 8/2023 Scrafford ..... E04G 3/22 52/633
2024/0052648 A1 * 2/2024 Ono ..... E04G 7/02
2024/0392584 A1 * 11/2024 Ono ..... E04G 5/08

FOREIGN PATENT DOCUMENTS

CN 107916772 A * 4/2018 ..... E04G 3/22
CN 109057309 A * 12/2018 ..... E04G 5/007
CN 117822868 A * 4/2024 ..... E04G 27/00
EP 2940231 A1 * 11/2015 ..... E04G 7/14
GB 1322498 A * 7/1973 ..... E04G 7/308
GB 2568451 A * 5/2019 ..... E04G 3/30
JP 08013788 * 1/1996
JP H08-013788 A 1/1996
JP H11107523 A * 4/1999
JP 3223667 U * 10/2019
JP 7049016 B1 * 4/2022
JP 2023117754 A * 8/2023
KR 101434346 B1 * 8/2014
SE 464983 B * 7/1991 ..... E04G 3/22
SE 467164 B * 6/1992 ..... E04G 3/22
WO WO-2025015297 A1 * 1/2025 ..... E04G 7/26

OTHER PUBLICATIONS

JP_08013788 (1996).*
Sep. 3, 2024, Japanese Office Action issued for related JP Application No. 2024-090878.
Jan. 14, 2025, Japanese Office Action issued for related JP Application No. 2024-090878.
Apr. 8, 2025, Japanese Decision to Grant a Patent issued for related JP Application No. 2024-090878.

* cited by examiner

HANGING SCAFFOLD AND METHOD FOR ASSEMBLING HANGING SCAFFOLD

CROSS REFERENCE TO PRIOR APPLICATION

This application claims priority to Japanese Patent Application No. 2024-090878 (filed on Jun. 4, 2024), which is hereby incorporated by reference in its entirety.

BACKGROUND

Technical Field

The present invention relates to a hanging scaffold and a method for assembling a hanging scaffold.

Related Art

As the conventional hanging scaffold, there is one that is suspended from a building or a structure by a hanging member such as a chain and is used in construction or maintenance work of the building or the structure.

For example, a hanging scaffold disclosed in JP 3223667 U includes a plurality of beam members arranged in parallel with each other and scaffold panels bridged between the beam members. The beam member is formed in a truss shape by four beam materials arranged side by side vertically and horizontally and extending in parallel with each other, and a plurality of diagonal members bridged between the upper and lower beam materials.

However, in the hanging scaffold configured as described above, since the beam member is large with four beam materials and a plurality of diagonal members, the entire hanging scaffold is enlarged. Therefore, it is difficult to install a hanging scaffold of JP 3223667 U in a place where there are many obstacles around.

On the other hand, the hanging scaffold of JP 7049016 B includes a scaffold board having a plurality of beam members, a joint connecting end portions of the beam members, and a plurality of work floors installed between the beam members. The beam member includes a pair of upper and lower beam materials, a bundle member connecting the upper beam material and the lower beam material, and a pair of left and right plate members provided between the upper beam material and the end portion of the lower beam material when viewed from the axial direction. Therefore, in the beam member of the hanging scaffold of JP 7049016 B, since the beam materials are not arranged side by side in the horizontal direction, the structure of the beam member is compact. When the structure of the beam member becomes compact as described above, the hanging scaffold can be installed even in a place where there are many obstacles around.

In addition, in the hanging scaffold of JP 7049016 B, a plate in a joint including a cylindrical body whose axis is along a vertical direction and a plurality of plates arranged at predetermined intervals in a circumferential direction on an outer periphery of the cylindrical body is inserted into a gap between plate members of a beam member, and a pin is inserted into a hole formed in a portion protruding from the plate member of the plate, whereby the beam member is connected to the plate of the joint.

SUMMARY

In the hanging scaffold of JP 7049016 B configured as described above, new beam members are connected to the joints arranged side by side, and the work floor is installed between the beam members adjacent to each other, whereby the floor area of the hanging scaffold can be expanded in a state of being suspended from a building, a construction, or the like.

Here, in the pair of plate members provided at the end portions of the beam member, upper and lower ends are connected to the upper beam material and the lower beam material, respectively. Therefore, in order to insert the plate of the joint into the gap between the plate members of the beam member, it is necessary to insert the plate of the joint between the plate members of the beam member from the lateral direction.

As described above, in order to connect the beam member to the joint of the conventional hanging scaffold in a state of being suspended from a building, a construction, or the like, the worker needs to pull the beam member toward the joint side and insert the plate between the plate members while bending over the work floor and maintaining the beam member in a horizontal posture at a position where the gap between the plate members faces the plate of the joint.

Therefore, an object of the present invention is to provide a hanging scaffold capable of safely and easily connecting a beam member to a joint without allowing a worker to bend over a work floor while making the beam member compact, and a method for assembling the hanging scaffold.

In order to achieve the above object, a hanging scaffold of the present invention includes: a scaffold body including a plurality of beam members arranged in parallel, a joint connected to end portions of the beam members by a connecting member, and a work floor installed between the beam members; and a hanging member that suspends the scaffold body, in which the beam member includes: a beam material; and a pair of attachment pieces provided at respective lower ends of each end portion of the beam material, arranged side by side in a horizontal direction when viewed from an axial direction, and formed with pin holes facing each other, the joint includes: a cylindrical body having an axis along a vertical direction; and a plurality of plates arranged at predetermined intervals in a circumferential direction on an outer periphery of the cylindrical body, and fittable between the attachment pieces along the axial direction of the cylindrical body, and the plate includes: a recessed portion formed at an upper end; and an insertion hole facing the pin hole of the attachment piece in a state of being fitted between the attachment pieces, and the connecting member is a coupling pin inserted into the pin hole and the insertion hole facing each other in a state where the plate is fitted between the attachment pieces. According to this configuration, since the beam member does not include beam materials arranged side by side, the beam member has a compact structure. Then, in a state in which one end of the beam material of the beam member is erected downward and inserted into the recessed portion in a posture along the vertical direction, the other end of the beam material is rotated to the back side with one end of the beam material as a fulcrum, the plate is fitted between the attachment pieces on one end side of the beam material, and the coupling pin is inserted into the pin hole of the attachment piece and the insertion hole of the plate facing each other, whereby the beam member can be connected to the joint. In such connection work of the beam members, it is not necessary for the worker to bend over the work floor of the scaffold body suspended and supported by a building, a construction, or the like. Therefore, it is possible to safely perform an operation of connecting the beam member to the joint of the scaffold body while configuring the beam member compactly.

In addition, a method for assembling a hanging scaffold of the present invention is a method for assembling a hanging scaffold, which includes a scaffold body including a plurality of beam members arranged in parallel, a joint connected to end portions of the beam members by a connecting member, and a work floor installed between the beam members; and a hanging member that suspends the scaffold body, in which the beam member includes: a beam material; and a pair of attachment pieces provided at respective lower ends of each end portion of the beam material, arranged side by side in a horizontal direction when viewed from an axial direction, and formed with pin holes facing each other, the joint includes: a cylindrical body having an axis along a vertical direction; and a plurality of plates arranged at predetermined intervals in a circumferential direction on an outer periphery of the cylindrical body, and fittable between the attachment pieces along the axial direction of the cylindrical body, and the plate includes: a recessed portion formed at an upper portion; and an insertion hole facing the pin hole of the attachment piece in a state of being fitted between the attachment pieces, and the connecting member is a coupling pin inserted into the pin hole and the insertion hole facing each other in a state where the plate is fitted between the attachment pieces, the method includes a step of inserting one end of the beam material into the recessed portion in a posture along the vertical direction; a step of rotating and folding the other end of the beam material to a back side in a state where one end of the beam material is inserted into the recessed portion, and fitting the plate between the attachment pieces on one end side of the beam material; and a step of inserting the coupling pin into the pin hole of the attachment piece and the insertion hole of the plate facing each other. According to such an assembling method, in the step of inserting one end of the beam material into the recessed portion in a posture along the vertical direction, the step of rotating and folding the other end of the beam material to the back side in a state where the one end of the beam material is inserted into the recessed portion, and fitting the plate between the attachment pieces on the one end side of the beam material, and the step of inserting the coupling pin into the pin hole of the attachment piece and the insertion hole of the plate facing each other, the worker does not need to bend over the work floor of the scaffold body suspended and supported by a building, a construction, or the like. Therefore, according to such an assembling method of a hanging scaffold, it is possible to safely perform an operation of connecting the beam member to the joint of the scaffold body while configuring the beam member compactly.

DETAILED DESCRIPTION

Figure 1:
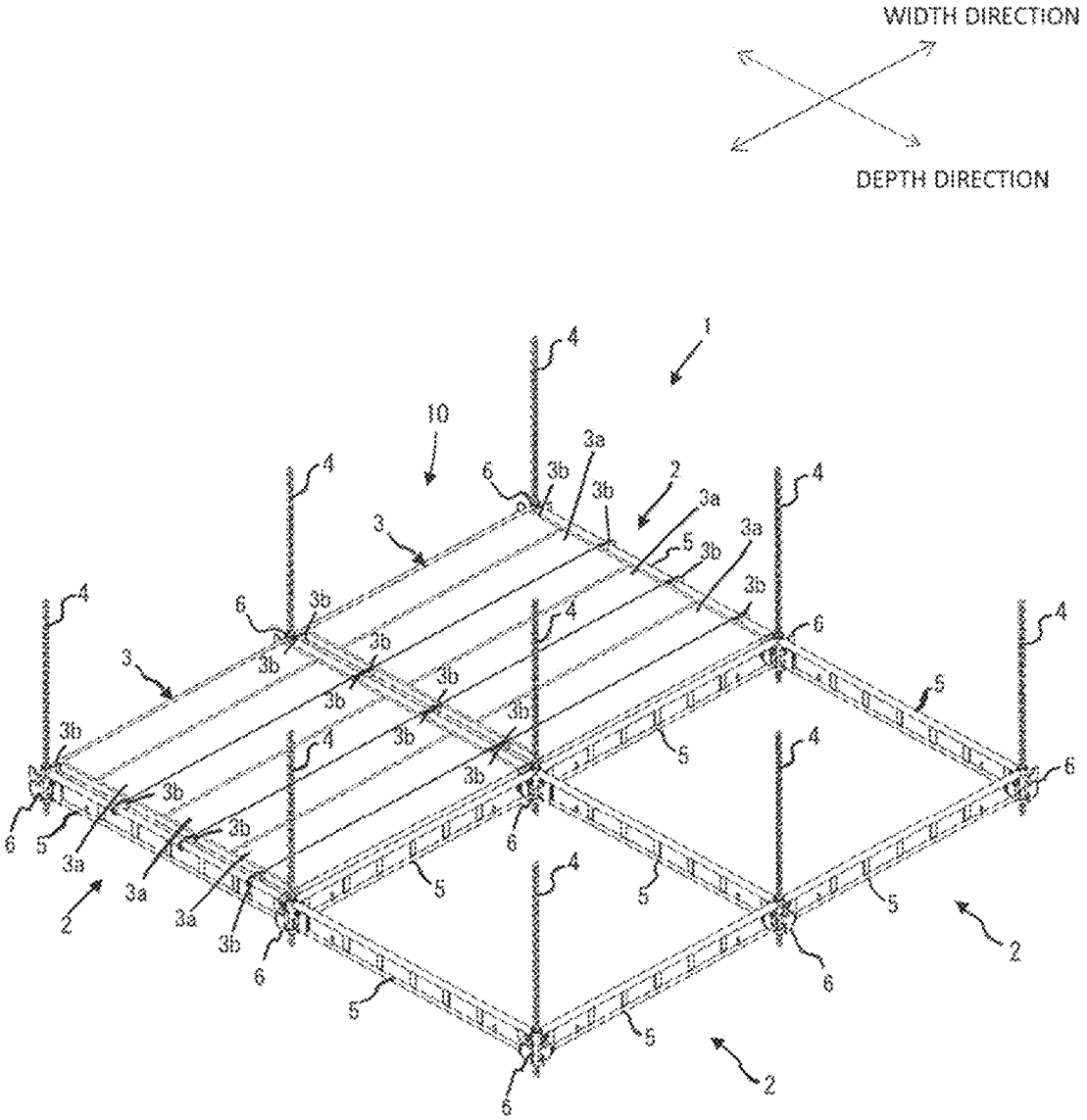
FIG. 1 is a perspective view illustrating a hanging scaffold of the present embodiment.

Hereinafter, the present embodiments will be described with reference to the drawings. The same reference numerals given throughout the several drawings indicate the same parts.

A hanging scaffold 1 of the present embodiment includes a scaffold body 10 having a plurality of beam members 5 and 5 arranged in parallel, a joint 6 connected to an end portion of the beam member 5, and a work floor 3 installed between the beam members 5 and 5, and a chain 4 as a hanging member that hangs the scaffold body 10.

In the present embodiment, as illustrated in FIG. 1, the scaffold body 10 includes a plurality of frame bodies 2 formed by connecting a plurality of beam members 5 to each joint 6, and the work floor 3 including a plurality of scaffold boards 3*a* bridged between the beam members 5 and 5 of each frame body 2, in which each frame body 2 is connected and disposed in a depth direction and a width direction. In FIG. 1, the work floor 3 installed in some of the frame bodies 2 is omitted in order to facilitate understanding of the structure of the scaffold body 10. In addition, although the hanging scaffold 1 illustrated in FIG. 1 includes four frame bodies 2 arranged in two rows in the width direction and two rows in the depth direction, the number of frame bodies 2 may be arbitrarily determined according to the floor area of the scaffold body 10, and the number of frame bodies 2 may be one. Note that the hanging member that hangs the scaffold body 10 is not limited to a chain, and may be, for example, a wire rope.

More specifically, the frame body 2 is formed in a quadrangular shape in plan view by two beam members 5 and 5 arranged in parallel along the depth direction, two beam members 5 and 5 arranged in parallel along the width direction, and four joints 6 connected to end portions of the beam members 5 by coupling pins 7 as connecting members to be described later and connecting the end portions of the beam members 5, and the frame bodies 2 adjacent to each other in the depth direction and the width direction share one beam member 5 at the center and the joint 6 connected to both ends of the beam member 5. In the present embodiment, the frame body 2 includes the two beam members 5 and 5 arranged in parallel along the depth direction and the two beam members 5 and 5 arranged in parallel along the width direction. However, when the two beam members 5 and 5 arranged in parallel along the depth direction are connected by the work floor 3 to function as a structure, the two beam members 5 and 5 arranged in parallel along the width direction may be omitted. In addition, the shape of the frame body 2 may also be a shape other than a square in plan view, for example, a rectangular shape or a parallelogram shape.

Figure 2:
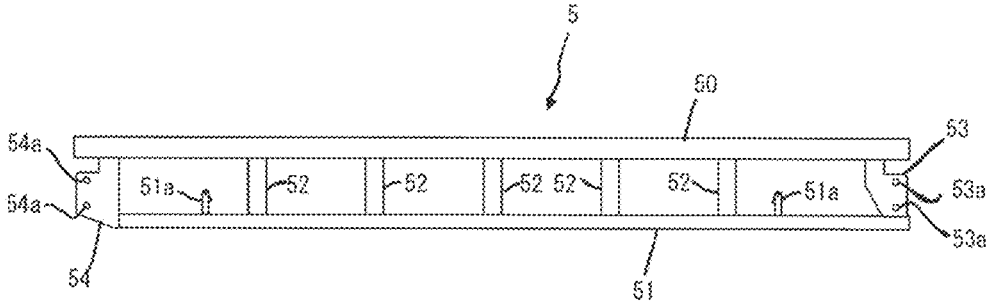
FIG. 2 is a side surface of the beam member of the present embodiment.
Figure 3:
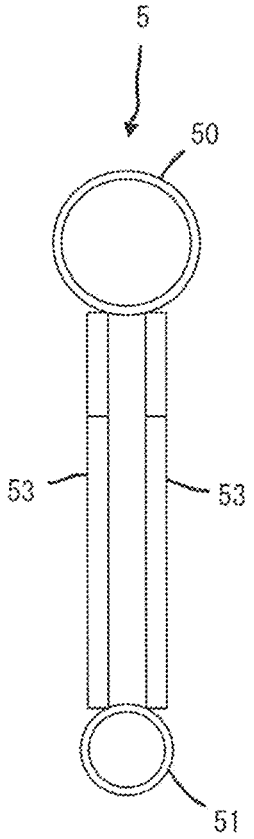
FIG. 3 is a front view of the beam member of the present embodiment as viewed from one end side.

As illustrated in FIGS. 2 and 3, the beam member 5 includes a pair of upper and lower beam materials 50 and 51, a plurality of bundle members 52 bridging between the upper beam materials 50 and the lower beam materials 51 and connecting the beam materials 50 and 51, and a pair of left and right attachment pieces 53, 53, 54, and 54 having a flat plate shape extending along the vertical direction from a lower portion of each end portion of the upper beam material 50 and viewed from the axial direction. As described above, the beam member 5 of the present embodiment does not have a structure in which beam materials are arranged side by side, and thus has a compact structure in the width direction.

Further, as illustrated in FIG. 2, the lower beam material 51 is provided with pin-shaped fixing portions 51*a* and 51*a* protruding upward from upper portions at two positions on the left and right in the axial direction. Although not illustrated, by bridging brace members (not illustrated) diagonally across the fixing portions 51*a* and 51*a* between the lower beam materials 51 and 51 facing each other in the depth direction or the width direction in the frame body 2, the strength of the frame body 2 can be increased. However, if the strength of the frame body 2 is not insufficient even if the brace member is not installed, the fixing portion 51*a* for installing the brace member may be omitted.

The attachment piece 53 and the attachment piece 54 have the same structure except for a part. Specifically, in each of the attachment pieces 53 and 54, two pin holes 53*a*, 53*a*, 54*a*, and 54*a* arranged side by side along the vertical direction when viewed from the axial direction of the beam member 5 are formed so as to face each other in the left-right direction. In the present embodiment, the upper beam material 50 and the lower beam material 51 are formed in a cylindrical shape, but may have a shape other than the cylindrical shape, for example, a square cylindrical shape.

In the present embodiment, as illustrated in FIGS. 2 and 3, the attachment piece 53 provided on the right side in FIG. 2 (hereinafter, referred to as "one-end-side attachment piece 53"), which is one end side of the beam member 5, is bridged between a lower portion of the upper beam material 50 and an upper portion of the lower beam material 51, since the upper end and the lower end are connected to the upper beam material 50 and the lower beam material 51, respectively, the lower side of the gap between the one-end-side attachment pieces 53 and 53 is closed by the lower beam material 51. On the other hand, in the attachment piece 54 provided on the left side in FIG. 2 (hereinafter, referred to as "the other-end-side attachment piece 54"), which is the other end side of the beam member 5, since the right side surface in FIG. 2 at the lower end is connected to the left end portion in FIG. 2 of the lower beam material 51, the lower side of the gap between the other-end-side attachment pieces 54 and 54 is open. However, the lower side of the gap between the one-end-side attachment pieces 53 and 53 may be opened, and the lower side of the gap between the other-end-side attachment pieces 54 and 54 may be closed by the lower beam material 51. Alternatively, the lower side of both the gap between the one-end-side attachment pieces 53 and 53 and the gap between the other-end-side attachment pieces 54 and 54 may be opened or closed.

As illustrated in FIG. 1, the work floor 3 is configured with a plurality of rectangular plate-shaped scaffold boards 3*a* bridged between the upper beam materials 50 and 50 of the beam members 5 and 5 facing each other in the width direction in the frame body 2.

One hook 3*b* is provided at each of four corners at both ends in the longitudinal direction of each scaffold board 3*a*, and by hooking the hook 3*b* on the upper beam material 50 of the beam member 5, the scaffold board 3*a* is bridged between the upper beam materials 50 and 50 of the beam members 5 and 5 facing each other in the width direction. Although not illustrated, the hook 3*b* provided at one end in the longitudinal direction of the scaffold board 3*a* and the hook 3*b* provided at the other end are arranged so as to be shifted from each other in the lateral direction of the scaffold board 3*a*. Therefore, when the scaffold boards 3*a* are installed in the frame bodies 2 and 2 adjacent to each other in the width direction, the hooks 3*b* of the scaffold boards 3*a* of the adjacent frame bodies 2 and 2 are hooked on the central beam member 5, but the hooks 3*b* and 3*b* of each work floor 3 are arranged so as to be staggered on the central beam member 5 shared by the frame bodies 2 and 2 adjacent to each other in the width direction, so that the hooks 3*b* and 3*b* do not interfere with each other.

Note that the configuration of the work floor 3 described above is an example, and the work floor 3 may be configured by one scaffold board 3*a*, or the scaffold board 3*a* may be connected to the beam member 5 via an attachment bracket other than a hook, and the scaffold board 3*a* may be bridged between the beam members 5 and 5 facing each other in the width direction.

As described above, since the plurality of scaffold boards 3*a* are hooked on the upper beam material 50, the load of the work floor 3 acts more on the lower beam material 51. Therefore, since the upper beam material 50 is required to have higher bending strength than the lower beam material 51, the diameter of the upper beam material 50 is larger than the diameter of the lower beam material 51 as illustrated in FIG. 3. However, as long as the strength of the beam member 5 is not insufficient, the diameter of the lower beam material 51 may be the same as the diameter of the upper beam material 50, or the diameter of the lower beam material 51 may be larger than the diameter of the upper beam material 50.

Figure 4:
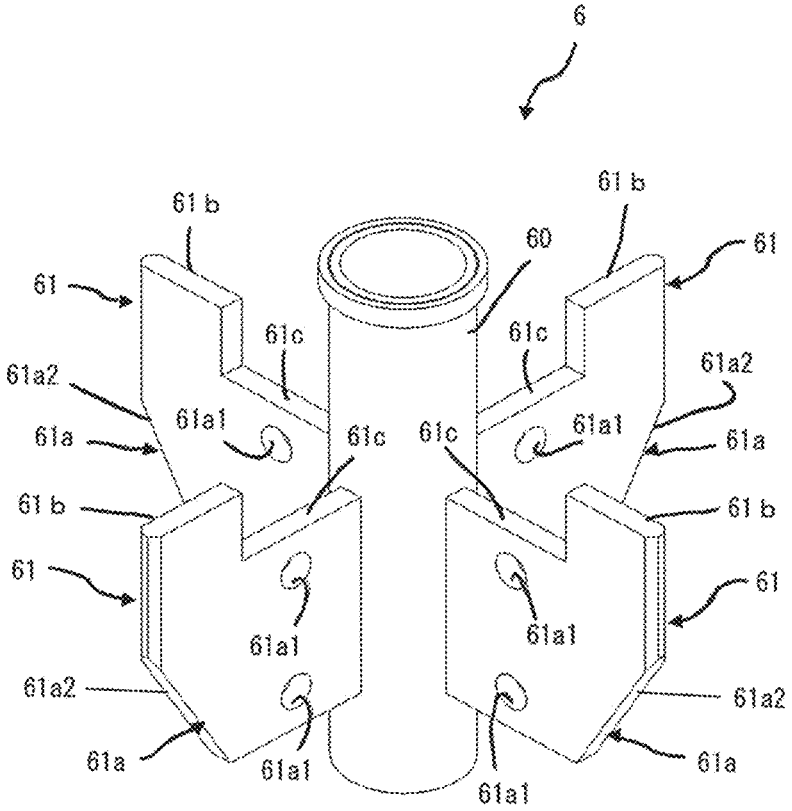
FIG. 4 is a perspective view illustrating a joint of the present embodiment.

As illustrated in FIG. 4, the joint 6 includes a cylindrical body 60 having an axis extending along the vertical direction, and four plates 61 disposed at intervals of 90 degrees in the circumferential direction on an outer periphery of the cylindrical body 60 and extending along the axial direction of the cylindrical body 60. The shape of the cylindrical body 60 is not limited to a cylindrical shape as long as it is a tubular shape.

The plate 61 includes a plate main body 61*a* that protrudes from the outer periphery of the cylindrical body 60 in the radial direction of the cylindrical body 60 and is oriented vertically along the axial direction of the cylindrical body 60, a protruding portion 61*b* that protrudes upward from an upper portion of the plate main body 61*a* on the distal end side, and a recessed portion 61*c* formed between the protruding portion 61*b* and the cylindrical body 60. In the present embodiment, the recessed portion 61*c* is formed between the protruding portion 61*b* at an upper end of the plate 61 and the cylindrical body 60, but the position of the recessed portion 61*c* is not particularly limited, and for example, the recessed portion 61*c* may be formed at a position separated from the cylindrical body 60 at the upper end of the plate 61.

Figure 5:
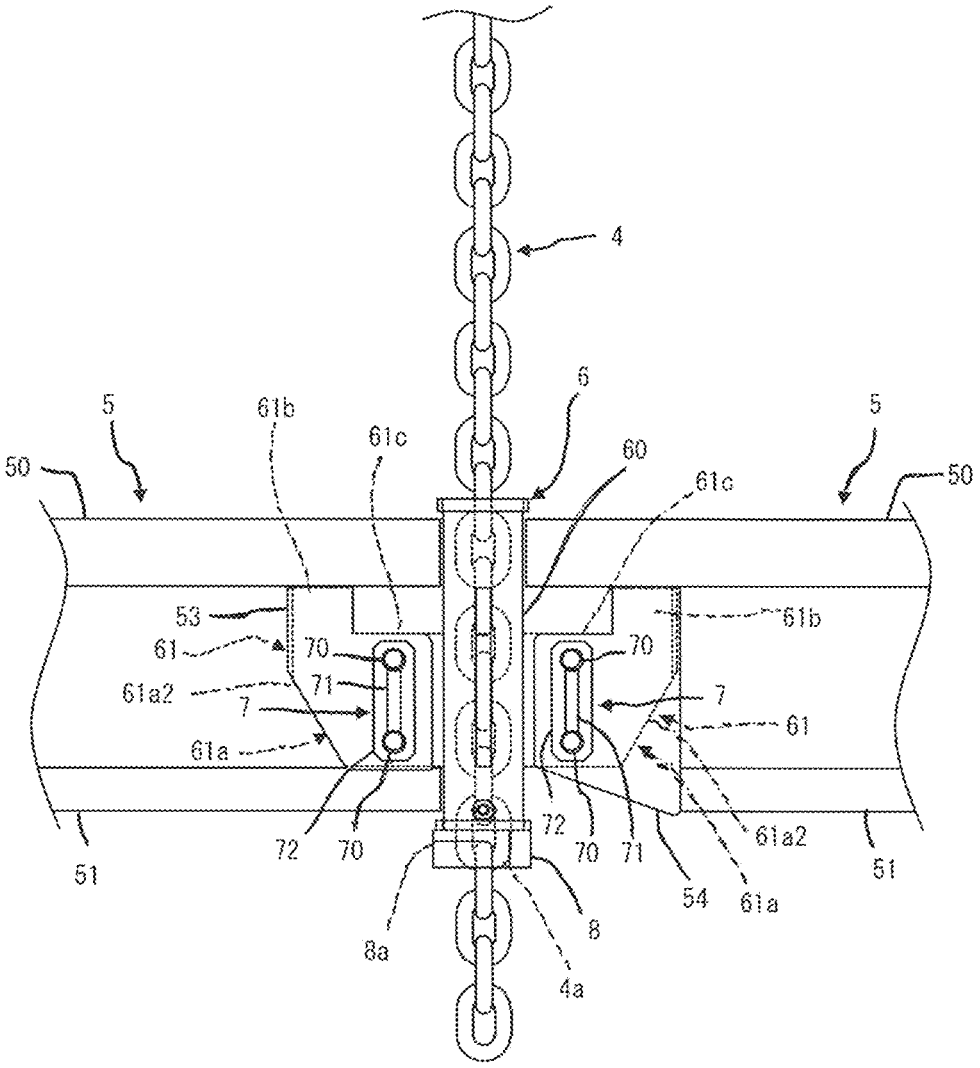
FIG. 5 is an enlarged side view illustrating a connecting portion between a joint and a beam member of the present embodiment.

As illustrated in FIG. 5, an upper end of the protruding portion 61*b*, which is the upper end of the plate 61, is located below the upper end of the cylindrical body 60. Further, the width of the recessed portion 61*c* in the extending direction of the plate 61 (hereinafter, simply referred to as a "width of the recessed portion 61*c*") is set to be larger than the height of the upper beam material 50 in the vertical direction.

In addition, the length of the plate 61 in the vertical direction is slightly shorter than the vertical interval between the upper beam material 50 and the lower beam material 51 of the beam member 5, and the plate thickness of the plate 61 is slightly thinner than the size of the gap between the attachment pieces 53, 53, 54, and 54 of the beam member 5, so that the plate 61 can be fitted between the attachment pieces 53, 53, 54, and 54 as illustrated in FIG. 5. In addition, since the upper end and the lower end of the one-end-side attachment piece 53 are respectively connected to the upper beam material 50 and the lower beam material 51, in a state where the plate 61 is fitted between the one-end-side attachment pieces 53 and 53, the plate 61 is sandwiched between the upper beam material 50 and the lower beam material 51 unlike a case where the plate is fitted between the other-end-side attachment pieces 54 and 54, and thus, the relative movement of the beam member 5 and the joint 6 in the vertical direction is restricted.

Further, in the plate main body 61*a*, two insertion holes 61*a*1 and 61*a*1 which are arranged side by side along the vertical direction and face the pin holes 53*a* and 54*a* of the attachment pieces 53 and 54 are formed in a state where the plate 61 is fitted between the attachment pieces 53, 53, 54, and 54. As illustrated in FIG. 4, the plate main body 61*a* is provided with a relief portion 61*a*2 formed by obliquely cutting out the lower side of an opposite cylindrical body side.

Then, as illustrated in FIG. 5, in a state where the plate 61 of the joint 6 is fitted between the attachment pieces 53, 53, 54, and 54 of the beam member 5, the beam member 5 is connected to the plate 61 of the joint 6 by inserting pin portions 70 of coupling pins 7, which will be described later, as connecting members into the two pin holes 53*a*, 53*a*, 54*a*, and 54*a* and the insertion holes 61*a*1 and 61*a*1 facing each other.

In addition, in the present embodiment, since the attachment pieces 53, 53, 54, and 54 of the beam member 5 are pin-bonded to the plate 61 of the joint 6 at two locations, the rotation of the beam member 5 in the vertical direction with respect to the plate 61 is restricted as compared with the case where the attachment pieces 53, 53, 54, and 54 of the beam member 5 are pin-bonded to the plate 61 of the joint 6 at one location, so that rattling of the beam member 5 in the vertical direction is suppressed.

In the present embodiment, as illustrated in FIG. 5, the shapes of the attachment pieces 53, 53, 54, and 54 are substantially matched with the plate 61 in a state where the plate 61 is fitted between the attachment pieces 53, 53, 54, and 54. However, the shapes of the attachment pieces 53, 53, 54, and 54 are not particularly limited, and may be rectangular plate shapes, for example.

Figure 6:
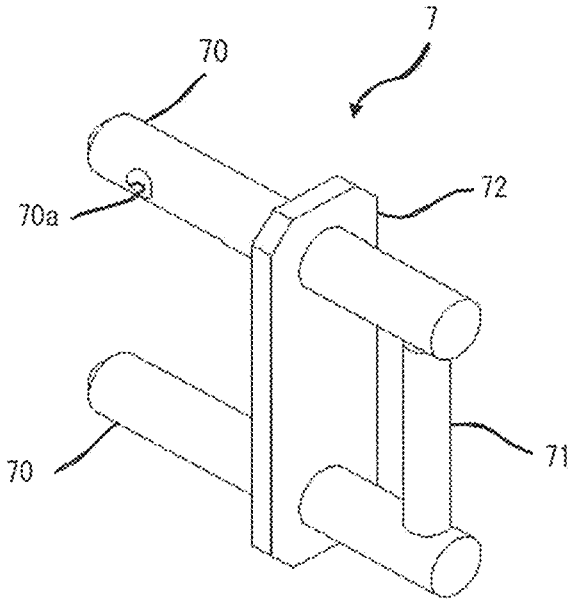
FIG. 6 is a perspective view illustrating a coupling pin of the present embodiment.

In addition, as illustrated in FIG. 6, the coupling pin 7 of the present embodiment includes a pair of pin portions 70 and 70 that can be inserted into the pin hole 53*a* and the insertion hole 61*a*1 and are arranged in parallel to each other at the same interval as the pair of pin holes 53*a*, 53*a*, 54*a*, and 54*a* and the pair of insertion holes 61*a*1 and 61*a*1, a columnar grip portion 71 as a connecting portion that connects the proximal end sides of the pair of pin portions 70 and 70, and a rectangular plate-shaped regulating portion 72 as a connecting portion that connects the vicinities of the centers of the pair of pin portions 70 and 70.

When the coupling pin 7 is configured as described above, the worker can insert the two pin portions 70 into the two pin holes 53*a*, 53*a*, 54*a*, and 54*a* and the insertion holes 61*a*1 and 61*a*1 (hereinafter referred to as "holes 53*a*, 54*a*, and 61*a*1") formed in the attachment pieces 53 and 54 and the plate 61 while holding the grip portion 71. As described above, since the two pin portions 70 and 70 can be inserted into the two holes 53*a*, 54*a*, and 61*a*1 of the attachment pieces 53 and 54 and the plate 61 at one time, the efficiency of the work of connecting the beam member 5 to the joint 6 is improved as compared with the case of inserting one pin into each of the two holes 53*a*, 54*a*, and 61*a*1.

In the present embodiment, the regulating portion 72 is provided at a position in contact with the attachment pieces 53 and 54 when the pin portion 70 in the axial direction of the pin portion 70 is inserted to an appropriate position with respect to the attachment pieces 53 and 54 and the holes 53*a*, 54*a*, and 61*a*1 of the plate 61. Therefore, if the worker inserts the pin portion 70 into the holes 53*a*, 54*a*, and 61*a*1 until the regulating portion 72 abuts on the attachment pieces 53 and 54, the insertion amount of the pin portion 70 is always constant, so that it is possible to prevent variations in connection strength between the attachment pieces 53 and 54 of the beam member 5 and the plate 61 of the joint 6.

The regulating portion 72 may be, for example, a protrusion protruding from an outer periphery of the pin portion 70. Even in this case, the insertion amount of the pin portion 70 can be made constant. However, when the regulating portion 72 is bridged between the pin portions 70 and 70 as in the present embodiment, since the pair of pin portions 70 and 70 can be supported by the grip portion 71 and the regulating portion 72, the strength against the force acting in the radial direction of the pin portion 70 increases.

In the present embodiment, a through hole 70*a* penetrating in the radial direction is formed in a distal end portion of the pin portion 70 on one side (upper side in FIG. 6). The through hole 70*a* is disposed at a position protruding from the attachment pieces 53 and 54 in a state where the pin portion 70 is inserted into the attachment pieces 53 and 54 and the holes 53*a*, 54*a*, and 61*a*1 of the plate 61. Although not illustrated, by inserting a retaining pin (not illustrated) into the through hole 70*a* in a state where the pin portion 70 is inserted into the holes 53*a*, 54*a*, and 61*a*1, it is possible to prevent the coupling pin 7 from coming off from the attachment pieces 53 and 54 and the holes 53*a*, 54*a*, and 61*a*1 of the plate 61.

Note that the above-described configuration of the coupling pin 7 is an example, and for example, the coupling pin 7 may be configured by omitting either the grip portion 71 or the regulating portion 72. Alternatively, the coupling pin 7 may be formed as a plurality of independent pins, and the beam member 5 may be pin-bonded to the plate 61 of the joint 6 by inserting one pin into each of the attachment pieces 53 and 54 and the holes 53*a*, 54*a*, and 61*a*1 of the plate 61.

In addition, the number of the attachment pieces 53 and 54 and the holes 53*a*, 54*a*, and 61*a*1 of the plate 61 and the number of the pin portions 70 of the coupling pin may be three or more. Even in this case, since the attachment pieces 53 and 54 and the plate 61 are coupled at a plurality of positions, rattling of the beam member 5 in the vertical direction can be reduced, and since the plurality of pin portions 70 and 70 can be inserted into the attachment pieces 53 and 54 and the plurality of holes 53*a*, 54*a*, and 61*a*1 of the plate 61 at one time, workability is improved.

However, the number of the attachment pieces 53 and 54 and the holes 53*a*, 54*a*, and 61*a*1 of the plate 61 may be one. In this case, the coupling pin may be one independent pin.

In the present embodiment, the attachment pieces 53 and 54 and the holes 53*a*, 54*a*, and 61*a*1 of the plate 61 are arranged side by side along the vertical direction, but the direction in which the holes 53*a*, 54*a*, and 61*a*1 are arranged is not particularly limited, and may be arranged side by side along the lateral direction, for example. However, when the holes 53*a*, 54*a*, and 61*a*1 are arranged side by side along the vertical direction with respect to the attachment pieces 53 and 54 and the plate 61, the lateral width (width in the left-right direction in FIG. 2) of the attachment pieces 53 and 54 and the plate 61 can be shortened as compared with the case where the holes 53*a*, 54*a*, and 61*a*1 are arranged side by side along the lateral direction.

As described above, the beam member 5 can be coupled to each plate 61 of the joint 6 via the coupling pin 7. The frame body 2 is configured in a quadrangular shape in plan view by connecting each end portion of the beam member 5 to the mutually opposing plates 61 of the four joints 6 via coupling pins 7, respectively. In addition, when the hanging scaffold 1 includes a plurality of frame bodies 2 as illustrated in FIG. 1, the frame bodies 2 and 2 adjacent to each other in the depth direction or the width direction share one beam member 5 disposed at the center of the frame bodies 2 and 2 and the joint 6 connected to both end portions of the beam member 5 via coupling pins 7.

In the present embodiment, a lower portion of the chain 4 is connected to each joint 6 via a stopper 8. Specifically, the chain 4 is formed by connecting a plurality of annular-shaped chain elements 4*a* in a row. Hereinafter, the side of the chain element 4*a* facing the hole will be referred to as a front side, the width of the chain element 4*a* when viewed from the front side (lateral chain element 4*a*) will be referred to as a lateral width, and the width of the chain element 4*a* when viewed from the side (vertical chain element 4*a*) will be referred to as a vertical width.

The stopper 8 has a disk shape and includes a notch 8*a* having a width narrower than the lateral width of the chain element 4*a* and wider than the vertical width of the chain element 4*a*. Then, as illustrated in FIG. 5, with the notch 8*a* facing the vertical chain element 4*a* positioned below the lower end of the cylindrical body 60 of the chain 4 inserted into the cylindrical body 60 of the joint 6, the stopper 8 is horizontally moved toward the chain 4 side to insert the vertical chain element 4*a* into the notch 8*a*. Then, the stopper 8 is vertically sandwiched between the two lateral chain elements 4*a* and 4*a*. Since the width of the notch 8*a* is narrower than the width of the lateral chain element 4*a* (the lateral width of the chain element 4*a*), the notch 8*a* does not allow insertion of the lateral chain element 4*a*. Therefore, when the vertical chain element 4*a* is inserted into the notch 8*a* of the stopper 8, the vertical movement of the stopper 8 with respect to the chain 4 is regulated.

When the stopper 8 is suspended by the chain 4, the cylindrical body 60 is supported from below by the stopper 8, so that the frame body 2 can be suspended by the chain 4. The lower portion of the chain 4 is thus connected to the joint 6 via a stopper 8.

Since the upper end of the chain 4 is connected to a building, a construction, or the like, the scaffold body 10 is suspended and supported by the building, the construction, or the like via the plurality of chains 4. However, the configuration of the stopper 8 described above is an example, and the configuration of the stopper 8 is not particularly limited as long as the chain 4 can be attached to the joint 6. In addition, the number of chains 4 can be set to any number in accordance with the size and the supporting load of the scaffold body 10, and the chains 4 may not be connected to all the joints 6. In addition, means for connecting the chain 4 to the scaffold body 10 is not particularly limited, and the chain 4 may be connected to a portion other than the joint 6, for example, the beam member 5.

Next, a method for assembling the hanging scaffold 1 of the present embodiment will be described in detail. First, the beam member 5 and the joint 6 are connected by the coupling pin 7 as described above to assemble a plurality of frame bodies 2, the work floor 3 is installed on each frame body 2, and the scaffold body 10 is assembled on the ground. Then, the chain 4 whose upper end is connected to a building, a construction, or the like is connected to each joint 6 of the scaffold body 10 assembled on the ground via the stopper 8 (hereinafter, referred to as an "existing scaffold body 10"), and the chain 4 is lifted by a heavy machine or a chain block to fix the chain 4 to the building or the construction, so that the existing scaffold body 10 is suspended from the building, the construction, or the like as illustrated in FIG. 1.

Figure 7:
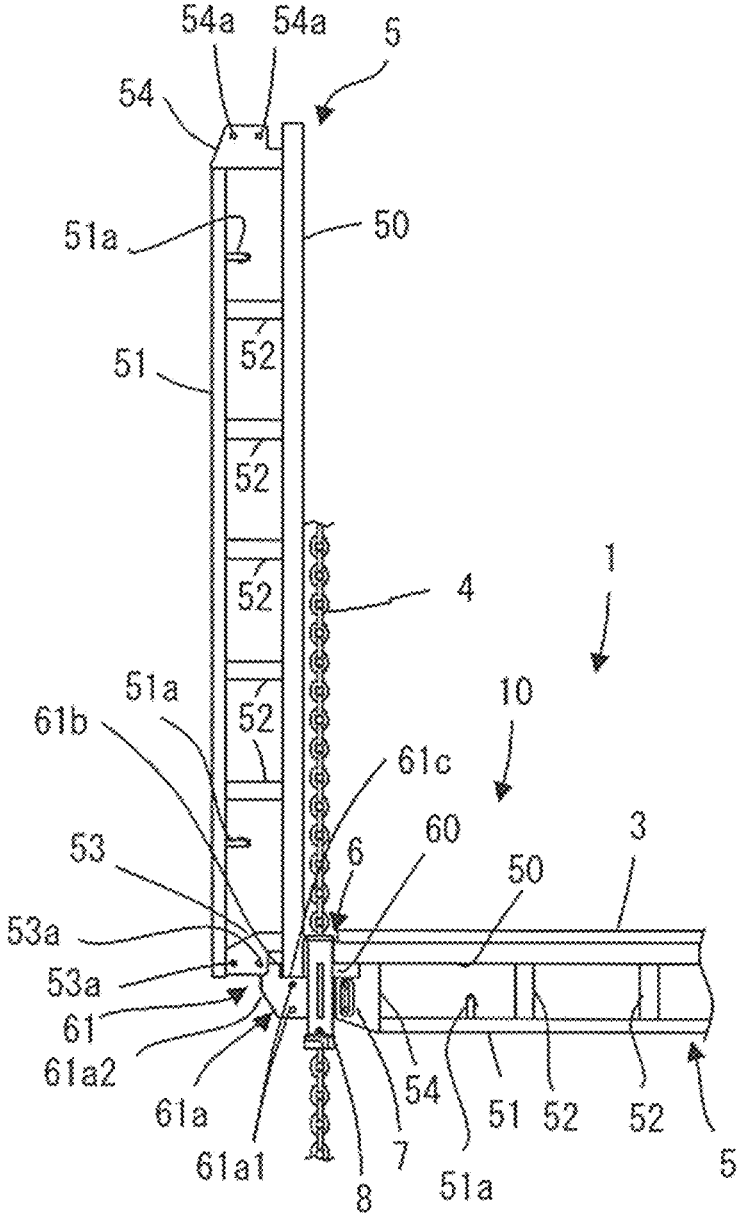
FIG. 7 is a view for explaining the method for assembling the hanging scaffold of the present embodiment, and is a view illustrating a step of inserting one end of the upper beam material of the beam member into a recessed portion of the plate of the joint in a posture along the vertical direction.

Next, a method of expanding the floor area of the scaffold body 10 suspended from a building, a construction, or the like will be described. Hereinafter, the components to be attached to the existing scaffold body 10 will be described with "for expansion" added to the end of the word. First, as illustrated in FIG. 7, the scaffold body 10 is inserted into the recessed portion 61*c* formed at the upper end of the plate 61 of the joint 6 disposed on the back side which is the side where the floor area is expanded in the depth direction in the existing scaffold body in a posture along the vertical direction standing with one end of the upper beam material 50 of the beam member 5 for expansion facing downward. Thereafter, as indicated by a solid line in FIG. 8, while supporting the other end of the beam member 5 for expansion via a support tool such as a rope (not illustrated) attached to the other end which is the distal end of the beam member 5 for expansion, the worker slowly unwinds the support tool with one end of the upper beam material 50 as a fulcrum and rotates the other end of the upper beam material 50 toward the back side to gradually tilt the expanding beam member 5. Note that the support tool by which the worker supports the beam member 5 for expansion may be other than a rope, and may be, for example, a belt, a chain, or a small crane.

Here, since the width of the recessed portion 61*c* is wider than the height of the upper beam material 50 in the vertical direction, as illustrated in FIG. 7, one end of the upper beam material 50 can be inserted into the recessed portion 61*c* in a posture along the vertical direction, and a gap is formed between one end of the upper beam material 50 and a side wall (the protruding portion 61*b* and the cylindrical body 60) of the recessed portion 61*c*. Then, since the upper beam material 50 can be brought into the posture along the vertical direction, the posture of the upper beam material 50 is stabilized in the recessed portion 61*c*, and since a gap is formed between one end of the upper beam material 50 and the side wall of the recessed portion 61*c* (the protruding portion 61*b* and the cylindrical body 60), the rotation of the upper beam material 50 to the back side is allowed, so that the work of tilting the beam member 5 for expansion in the posture along the vertical direction to the back side can be safely and easily performed.

The "posture along the vertical direction" of the upper beam material 50 described above when one end of the upper beam material 50 is inserted into the recessed portion 61*c* includes not only a posture along the vertical direction but also a posture inclined toward the back side. Therefore, the corner of one end of the upper beam material 50 may be inserted into the recessed portion 61*c* while the upper beam material 50 is inclined toward the back side from the beginning. As described above, when the corner of one end of the upper beam material 50 inclined toward the back side from the beginning is inserted into the recessed portion 61*c*, the width of the recessed portion 61*c* may be narrower than the height of the upper beam material 50 in the vertical direction as long as the corner of one end of the upper beam material 50 can be inserted.

Figure 8:
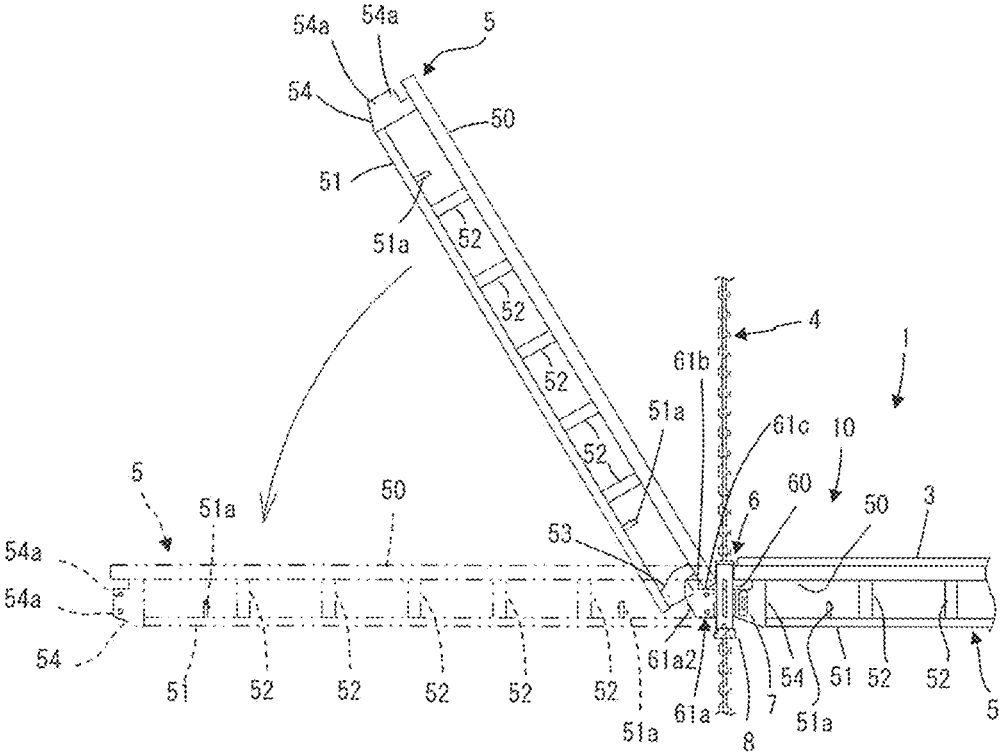
FIG. 8 is a view for explaining the method for assembling the hanging scaffold of the present embodiment, and is a view illustrating a step of rotating and laying down the other end of the upper beam material of the beam member toward the back side.

In addition, as indicated by a solid line in FIG. 8, in a state where the beam member 5 for expansion is inclined toward the back side, the corner of one end of the upper beam material 50 enters the recessed portion 61*c*, and the outer periphery of the one end abuts on a corner portion of an upper end of the protruding portion 61*b* which is a side wall on the back side of the recessed portion 61*c*. That is, the beam member 5 for expansion falls down to the back side while the upper beam material 50 is supported by the upper end of the plate 61. As described above, when the beam member 5 for expansion is tilted toward the back side, one end of the beam member 5 for expansion is supported by the joint 6, so that the beam member 5 for expansion can be safely tilted toward the back side. Furthermore, when the beam member 5 is tilted toward the back side, one end of the upper beam material 50 enters the recessed portion 61*c* and is supported until the beam member 5 takes a horizontal posture, and thus, it is possible to prevent one end of the upper beam material 50 from sliding on the upper surface of the plate 61 and moving.

Then, when the upper beam material 50 of the beam member 5 for expansion falls down until the axial direction takes a posture along the horizontal direction (lateral posture) as indicated by a broken line in FIG. 8, the lower end of the upper beam material 50 is supported by the upper end of the protruding portion 61*b*, the plate 61 is fitted between the one-end-side attachment pieces 53 and 53, and the pin hole 53*a* of the one-end-side attachment piece 53 and the insertion hole 61*a*1 of the plate 61 face each other.

Here, the upper end of the protruding portion 61*b*, which is the upper end of the plate 61, is located below the upper end of the cylindrical body 60. Therefore, when the upper beam material 50 of the beam member 5 for expansion takes a lateral posture, as indicated by a broken line in FIG. 8, since the end portion on one end side (right side in the drawing) of the upper beam material 50 faces the outer periphery of the cylindrical body 60, when the end portion of the upper beam material 50 is brought into contact with the outer periphery of the cylindrical body 60, the beam member 5 for expansion can be positioned in the extending direction (left-right direction in the drawing) of the plate 61. Note that the difference in height between the upper end of the protruding portion 61*b* and the upper end of the cylindrical body 60 may be equal to or less than the height of the upper beam material 50 in the vertical direction as long as the end portion of the upper beam material 50 is hooked by the cylindrical body 60. However, if it is unnecessary to position the beam member 5 for expansion in the extending direction of the plate 61, the upper end of the protruding portion 61*b* may be positioned above the upper end of the cylindrical body 60.

As described above, the pair of one-end-side attachment pieces 53 and 53 are vertically bridged between the upper beam material 50 and the lower beam material 51, and the lower side of the gap between the one-end-side attachment pieces 53 and 53 is closed by the lower beam material 51. Therefore, when the upper beam material 50 of the beam member 5 for expansion is in the lateral posture, the lower beam material 51 abuts on the lower end of the plate 61, and the upper beam material 50 of the beam member 5 for expansion can be prevented from further falling down, so that the beam member 5 for expansion can be positioned at a position where the pin hole 53*a* of the one-end-side attachment piece 53 and the insertion hole 61*a*1 of the plate 61 face each other.

In addition, when the pair of one-end-side attachment pieces 53 and 53 are bridged between the upper beam material 50 and the lower beam material 51 in this manner, when the beam member 5 for expansion is tilted to the back side and the plate 61 is fitted between the one-end-side attachment pieces 53 and 53, one point on the upper beam material 50 side of the edge of one end of the lower beam material 51 passes close to the plate 61. Then, if the plate 61 is on a path through which one point on the upper beam material 50 side of the edge of one end of the lower beam material 51 passes, the lower beam material 51 interferes with the plate 61, and the plate 61 cannot be successfully inserted between the one-end-side attachment pieces 53 and 53.

Therefore, the plate 61 of the present embodiment includes a relief portion 61*a*2 formed by cutting out the lower side on the opposite cylindrical body side to avoid interference with the lower beam material 51. Therefore, even if the pair of one-end-side attachment pieces 53 and 53 are bridged between the upper beam material 50 and the lower beam material 51 in this manner, when the beam member 5 for expansion is tilted to the back side and the plate 61 is fitted between the one-end-side attachment pieces 53 and 53, the lower beam material 51 of the beam member 5 for expansion does not interfere with the plate 61, and the plate 61 can be smoothly inserted between the one-end-side attachment pieces 53 and 53.

In the present embodiment, the relief portion 61*a*2 is formed by obliquely cutting out the plate main body 61*a*, but the cutout shape is not particularly limited, and may be formed by cutting out the plate main body 61*a* in an R-shape or a C-shape, for example. However, when the relief portion 61*a*2 is formed by obliquely cutting out the plate main body 61*a*, processing is easy as compared with a case of being formed by cutting out the plate main body 61*a* in an R-shape, and an area where the plate main body 61*a* is cut out is reduced as compared with a case of being formed by cutting out the plate main body 61*a* in a C-shape, so that a decrease in strength of the plate 61 can be suppressed.

In addition, the means for avoiding the interference of the lower beam material 51 with the plate 61 when the beam member 5 for expansion is tilted toward the back side and the plate 61 is fitted between the one-end-side attachment pieces 53 and 53 is not limited to the method of providing the relief portion 61*a*2 of the plate main body 61*a* on the opposite cylindrical portion side. For example, the length of the plate 61 in the vertical direction may be shortened to such an extent that the lower beam materials 51 do not interfere with each other, or the vertical interval between the upper beam material 50 and the lower beam material 51 may be increased to such an extent that the lower beam materials 51 do not interfere with each other. However, when the length of the plate 61 in the vertical direction is shortened, the strength of the plate 61 is reduced, and when the interval between the upper beam material 50 and the lower beam material 51 in the vertical direction is increased, the height of the beam member 5 in the vertical direction is increased, so that the beam member 5 is increased in size and the weight is increased.

On the other hand, when the relief portion 61*a*2 is provided on the opposite cylindrical portion side of the plate main body 61*a* as in the present embodiment to avoid interference of the lower beam material 51 with the plate 61, it is not necessary to change the vertical length of the plate 61 or the vertical interval between the upper beam material 50 and the lower beam material 51, so that it is possible to avoid an increase in the weight of the beam member 5 while preventing a decrease in the strength of the plate 61.

In the present embodiment, one end of the beam member 5 for expansion is inserted into the recessed portion 61*c* in a posture along the vertical direction. However, in a state where the other end of the beam member 5 for expansion is inserted into the recessed portion 61*c* of the plate 61 in a posture along the vertical direction, the beam member 5 for expansion may be tilted toward the back side, and the plate 61 may be fitted between the other-end-side attachment pieces 54 and 54. In this case, since the sides of the pair of other-end-side attachment pieces 54 and 54 are connected to the other end portion of the lower beam material 51, even if the plate 61 does not include the relief portion 61*a*2, the lower beam material 51 does not interfere with the plate 61 when the beam member 5 for expansion is tilted toward the back side and the plate 61 is fitted between the other-end-side attachment pieces 54 and 54.

In addition, the above-described step of inserting one end of the upper beam material 50 into the recessed portion 61*c* of the plate 61 in a posture along the vertical direction and the step of tilting the other end of the upper beam material 50 by rotating the other end of the upper beam material 50 to the back side in a state where one end of the upper beam material 50 is inserted into the recessed portion 61*c* and fitting the plate 61 between the one-end-side attachment pieces 53 and 53 of the upper beam member can be performed without allowing the worker to get on the work floor 3 of the existing scaffold body 10.

Thereafter, in a state where the upper beam material 50 of the beam member 5 for expansion is in the lateral posture, the coupling pin 7 is inserted into the pin hole 53*a* of the one-end-side attachment piece 53 and the insertion hole 61*a*1 of the plate 61 facing each other, and the beam member 5 is connected to the plate 61 of the joint 6. Here, since the plate 61 of the joint 6 is in close proximity to the work floor 3 of the existing scaffold body 10, the worker can perform the work of inserting the coupling pin 7 into the pin hole 53*a* of the one-end-side attachment piece 53 and the insertion hole 61*a*1 of the plate 61 without bending over the work floor 3.

As described above, according to the above method, in the work of connecting the beam member 5 for expansion to the joint 6 disposed on the back side in the depth direction in the existing scaffold body 10, the worker does not need to bend over the work floor 3 of the existing scaffold body 10, so that the work of expanding the floor area of the scaffold body 10 can be safely performed.

Figure 9:
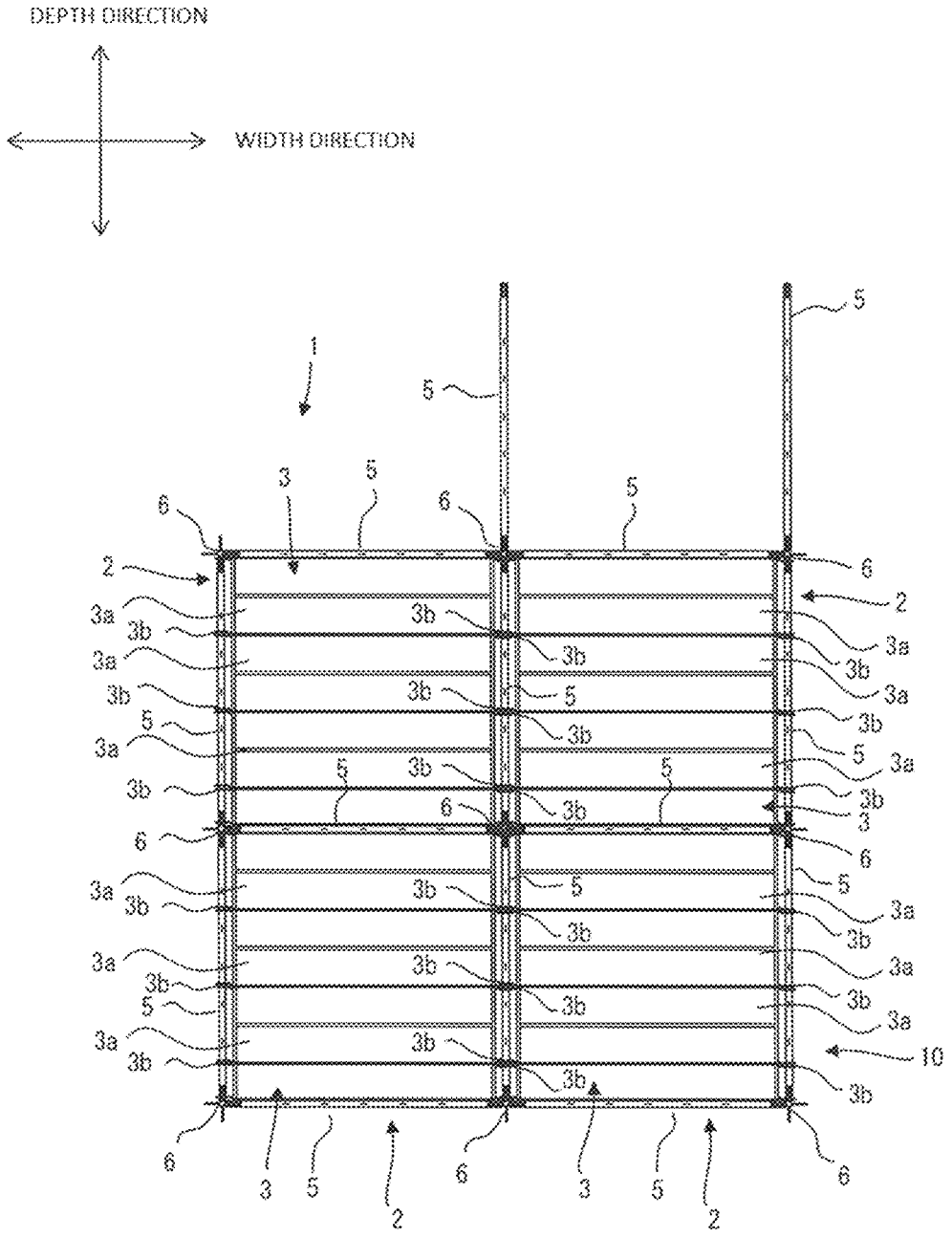
FIG. 9 is a view for explaining the method for assembling the hanging scaffold of the present embodiment, and is a view illustrating a step of arranging two beam members extending along the depth direction in parallel.

Subsequently, the beam member 5 for expansion is connected to the joint 6 adjacent in the width direction to the joint 6 to which the beam member 5 for expansion is connected in the same procedure. Then, as illustrated in FIG. 9, the two beam members 5 and 5 for expansion extending along the depth direction are arranged in parallel.

Figure 10:
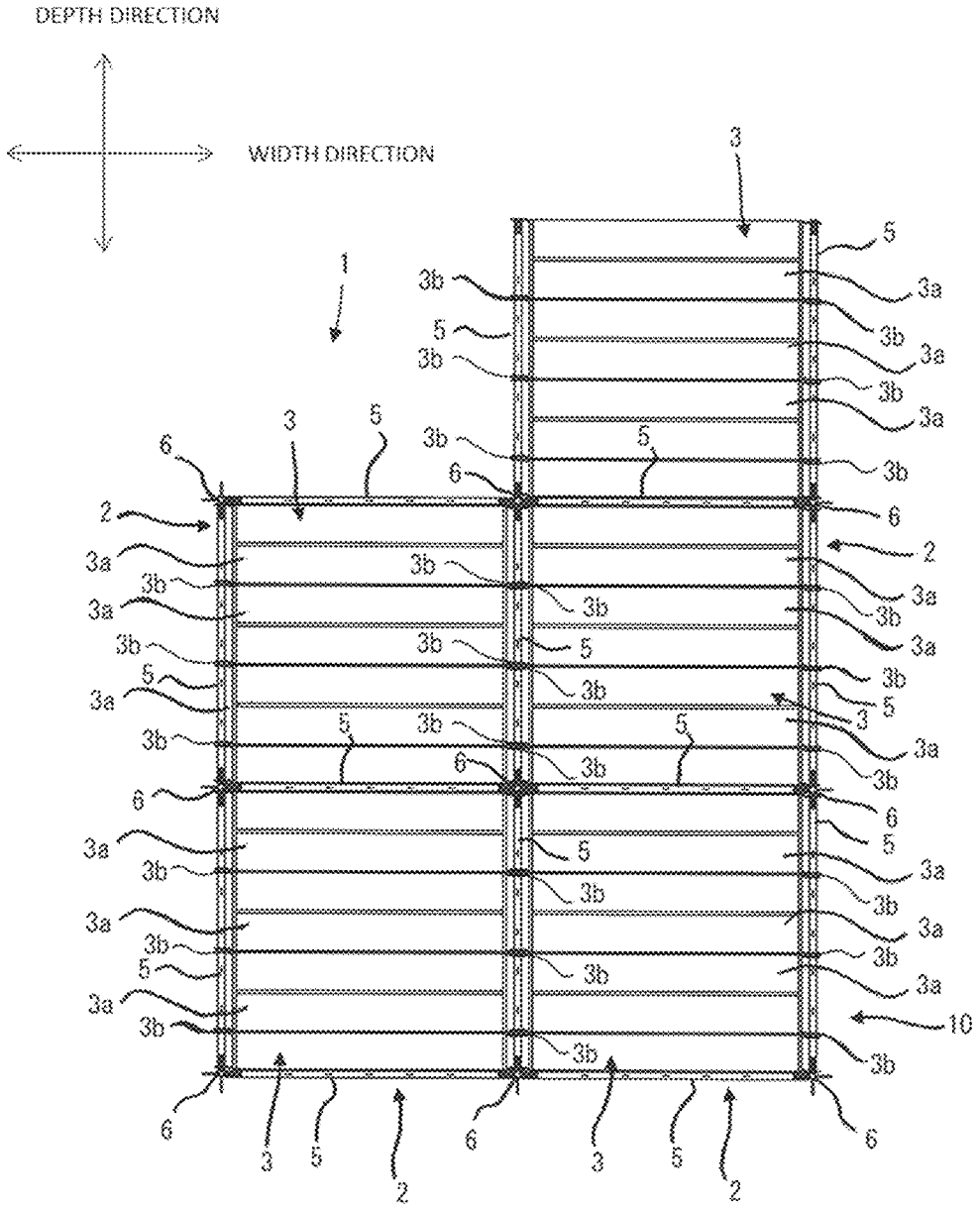
FIG. 10 is a view for explaining the method for assembling the hanging scaffold of the present embodiment, and is a view illustrating a step of installing a work floor between two beam members arranged in parallel.
Figure 11:
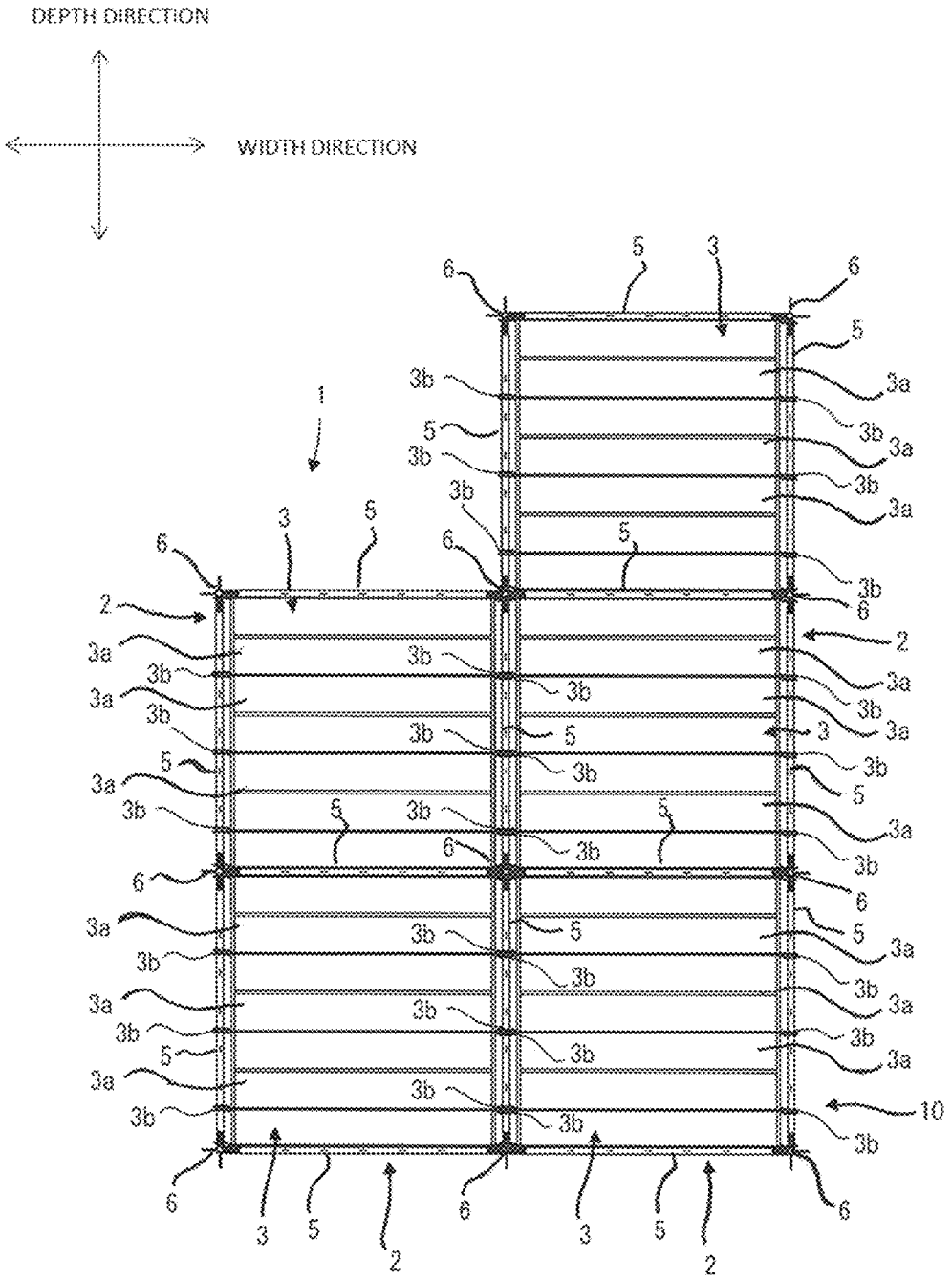
FIG. 11 is a view for explaining the method for assembling the hanging scaffold of the present embodiment, and is a view illustrating a step of bridging a beam member along the width direction between joints attached to the other ends of two beam members arranged in parallel.

Next, as illustrated in FIG. 10, a plurality of scaffold boards 3*a* for expansion are bridged between two beam members 5 and 5 for expansion arranged in parallel, and the work floor 3 is installed. Thereafter, as illustrated in FIG. 11, the joint 6 for expansion is attached to each of the other-end-side attachment pieces 54 and 54 of the two beam members 5 for expansion. Specifically, after the joint 6 for expansion is connected to the chain 4 suspended from a building, a construction, or the like in advance via the stopper 8, the joint 6 for expansion is attached to the other-end-side attachment piece 54 of the beam member 5 for expansion via the coupling pin 7. Then, in order to attach the chain 4 to the joint 6 for expansion, it is not necessary for the worker to bend over the work floor 3.

Finally, the end portions of the beam members 5 for expansion extending along the width direction are connected to the joints 6 and 6 for expansion attached to the other-end-side attachment pieces 54 and 54 of the two beam members 5 for expansion arranged in parallel, via the coupling pins 7. Also in these works, since the worker does not need to bend over the work floor 3, the worker can safely expand the floor area of the scaffold body 10.

By repeating the above procedure in the depth direction or the width direction, the hanging scaffold 1 of the present embodiment can expand the floor area of the scaffold body 10 to any position in a state of being suspended and supported by a building, a construction, or the like. The method for assembling the hanging scaffold 1 described above is an example, and is not limited to the method described above.

Figure 12:
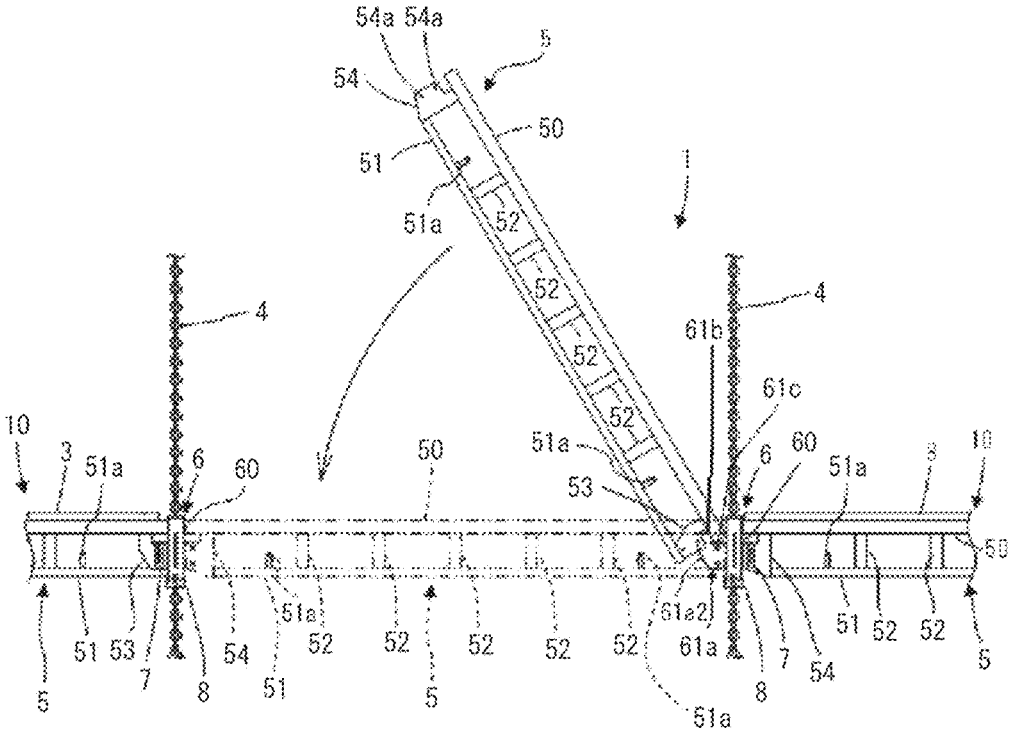
FIG. 12 is a view for explaining the method for assembling the hanging scaffold of the other embodiment, and is a view illustrating a step of bridging a beam member between joints of two hanging scaffolds.

In addition, one hanging scaffold 1 may be assembled by connecting the two existing scaffold bodies 10 and 10 in the air by simultaneously assembling the two existing scaffold bodies 10 and 10 in the air and bridging the beam member 5 for expansion between the joints 6 and 6 facing each other of the two existing scaffold bodies 10 and 10. Specifically, as illustrated in FIG. 12, the upper beam material 50 of the beam member 5 for expansion is inserted into the recessed portion 61*c* of the plate 61 of the joint 6 of one scaffold body 10 of the two existing scaffold bodies 10 and 10 on the right side in the drawing in a posture along the vertical direction with one end the upper beam material 50 facing downward, and is tilted toward the joint 6 side of the other scaffold body 10 on the left side in the drawing. Here, as described above, since the sides of the pair of other-end-side attachment pieces 54 and 54 provided on the other end side of the beam member 5 of the present embodiment are connected to the other end portion of the lower beam material 51, the lower side of the gap between the other-end-side attachment pieces 54 and 54 is open. Therefore, when the upper beam material 50 of the beam member 5 for expansion is tilted toward the other scaffold body 10 side, the upper beam material 50 of the beam member 5 for expansion covers and abuts on the upper end of the plate 61 of the joint 6 of the other scaffold body 10 from above, and the plate 61 is fitted between the other-end-side attachment pieces 54 and 54. Thereafter, the end portions of the beam members 5 for expansion are connected to the joints 6 via the coupling pins 7 from the work floors 3 of both the scaffold bodies 10 and 10, whereby the beam members 5 for expansion can be bridged and connected between the joint 6 of one scaffold body 10 and the joint 6 of the other scaffold body 10.

Although not illustrated, the two scaffold bodies 10 and 10 can be connected in the air by bridging the beam member 5 for expansion between the two joints 6 and 6 arranged in parallel of one scaffold body 10 and the two joints 6 and 6 arranged in parallel of the other scaffold body 10 in the above procedure, and bridging the plurality of scaffold boards 3*a* between the two beam members 5 and 5 for expansion to install the work floor 3. In this way, when two scaffold bodies 10 and 10 are connected in the air to assemble one hanging scaffold 1, the hanging scaffold 1 having a large floor board area can be assembled in a short time.

In the present embodiment, the gap between the other-end-side attachment pieces 54 and 54 provided on the other end side of the beam member 5 is opened downward so that the beam member 5 for expansion can be bridged between the joints 6 and 6 of the two scaffold bodies 10 and 10. However, in a case where use in such an application is not assumed, the gap between the other-end-side attachment pieces 54 and 54 may be closed by the lower beam material 51 similarly to the gap between the one-end-side attachment pieces 53 and 53. In this way, since the structures on one end side and the other end side of the beam member 5 are the same, it is possible to prevent the occurrence of an erroneous combination.

As described above, the hanging scaffold 1 of the present embodiment includes: the scaffold body 10 including the plurality of beam members 5 arranged in parallel, the joint 6 connected to end portions of the beam members 5 by a connecting member, and the work floor 3 installed between the beam members 5 and 5; and the chain 4 (hanging member) that suspends the scaffold body 10, in which the beam member 5 includes: the upper beam material 50 (beam material); and the pairs of attachment pieces 53, 53, 54 and 54 provided at lower ends of the respective end portions of the upper beam material 50, arranged side by side in a horizontal direction when viewed from an axial direction, and formed with pin holes 53*a* (54*a*) facing each other, the joint 6 includes: the cylindrical body 60 having an axis along a vertical direction; and the plurality of plates 61 arranged at predetermined intervals in a circumferential direction on the outer periphery of the cylindrical body 60, and fittable between the attachment pieces 53, 53, 54 and 54 along the axial direction of the cylindrical body 60, and the plate 61 includes: the recessed portion 61*c* formed at an upper end; and the insertion holes 61*a*1 facing the pin hole 53*a* and 54*a* of the attachment piece 53, 53, 54 and 54 in a state of being fitted between the attachment pieces 53, 53, 54 and 54, and the connecting member is the coupling pin 7 inserted into the pin hole 53*a* and 54*a* and the insertion holes 61*a*1 facing each other in a state where the plate 61 is fitted between the attachment pieces 53, 53, 54 and 54.

According to the hanging scaffold 1 configured as described above, since the beam member 5 does not include beam materials arranged side by side, the beam member has a compact structure. Then, in a state in which one end of the upper beam material 50 of the beam member 5 is erected downward and inserted into the recessed portion 61*c* in a posture along the vertical direction, the other end of the upper beam material 50 is rotated to the back side with one end of the upper beam material 50 as a fulcrum, the plate 61 is fitted between the one-end-side attachment pieces 53 and 53 of the upper beam material 50, and the coupling pins 7 are inserted into the pin holes 53*a* and 53*a* of the one-end-side attachment pieces 53 and 53 and the insertion holes 61*a*1 of the plate 61 facing each other, whereby the beam member 5 can be connected to the joint 6.

In such connection work of the beam members 5, it is not necessary for the worker to bend over the work floor 3 of the scaffold body 10 suspended and supported by a building, a construction, or the like. Therefore, in the hanging scaffold 1 of the present embodiment, it is possible to safely perform an operation of connecting the beam member 5 to the joint 6 of the scaffold body 10 while configuring the beam member 5 compactly.

In addition, when one end of the upper beam material 50 is inserted into the recessed portion 61*c*, one end of the upper beam material 50 can be supported by the joint 6 when the beam member 5 is tilted toward the back side. Therefore, when the beam member 5 is tilted toward the back side, one end of the beam member 5 is supported by the joint 6, so that the beam member 5 can be safely tilted toward the back side, and the operation of connecting the beam member 5 to the joint 6 of the scaffold body 10 can be safely and easily performed.

Furthermore, when the beam member 5 is tilted toward the back side, one end of the upper beam material 50 enters the recessed portion 61*c* and is supported until the beam member 5 takes a horizontal posture, and thus, it is possible to prevent one end of the upper beam material 50 from sliding on the upper surface of the plate 61 and moving, and it is possible to safely and easily perform the operation of connecting the beam member 5 to the joint 6 of the scaffold body 10.

In the present embodiment, the four plates 61 are arranged at intervals of 90 degrees on the outer periphery of the cylindrical body 60 of the joint 6, but the number of plates 61 may be appropriately determined according to the number of beam members 5 connected to the joint 6, and is not particularly limited as long as it is two or more. In addition, the arrangement interval of the plurality of plates 61 may be appropriately determined according to the shape of the frame body 2 forming the scaffold body 10.

In the hanging scaffold 1 of the present embodiment, the width of the recessed portion 61*c* is wider than the height of the upper beam material 50 in the vertical direction. According to the hanging scaffold 1 configured as described above, one end of the upper beam material 50 can be inserted into the recessed portion 61*c* in a posture along the vertical direction, and a gap is formed between one end of the upper beam material 50 and the side wall of the recessed portion 61*c*. Then, since the upper beam material 50 can be brought into the posture along the vertical direction, the posture of the upper beam material 50 is stabilized in the recessed portion 61*c*, and since a gap is formed between one end of the upper beam material 50 and the side wall of the recessed portion 61*c*, the rotation of the upper beam material 50 to the back side is allowed, so that the work of tilting the beam member 5 in the posture along the vertical direction to the back side can be safely and easily performed. Note that the width of the recessed portion 61*c* may be narrower than the height of the upper beam material 50 in the vertical direction as long as the insertion of the corner of one end of the upper beam material 50 can be permitted.

In the hanging scaffold 1 of the present embodiment, the upper end of the plate 61 is positioned below the upper end of the cylindrical body 60. In the hanging scaffold 1 configured as described above, since the end portion on one end side of the upper beam material 50 in the lateral posture faces the outer periphery of the cylindrical body 60, the beam member 5 can be positioned in the extending direction of the plate 61 by bringing the end portion of the upper beam material 50 into contact with the outer periphery of the cylindrical body 60. Therefore, the pin holes 53*a*, 53*a*, 54*a*, and 54*a* of the attachment pieces 53 and 54 and the insertion holes 61*a*1 can be easily aligned. However, the upper end of the plate 61 may be positioned above the upper end of the cylindrical body 60.

In the hanging scaffold 1 of the present embodiment, the beam member 5 includes the lower beam material 51 arranged side by side below the upper beam material 50 and extending in parallel with the upper beam material 50, and the pair of one-end-side attachment pieces (attachment pieces) 53 and 53 are vertically bridged between the upper beam material 50 and the lower beam material 51.

In the hanging scaffold 1 configured as described above, since the lower side of the gap between the one-end-side attachment pieces 53 and 53 is closed by the lower beam material 51, when the upper beam material 50 is tilted until the upper beam member is brought into a lateral posture in a state where one end of the upper beam material 50 is directed downward and inserted into the recessed portion 61*c* in a posture along the vertical direction, the lower beam material 51 comes into contact with the lower end of the plate 61 and the upper beam material 50 of the beam member 5 can be prevented from further falling down, so that the beam member 5 can be positioned at a position where the pin hole 53*a* of the one-end-side attachment piece 53 and the insertion hole 61*a*1 of the plate 61 face each other. Therefore, the operation of connecting the beam member 5 to the plate 61 of the joint 6 is facilitated.

In the hanging scaffold 1 of the present embodiment, the plate 61 includes the relief portion 61*a*2 formed by cutting out the lower side of the plate 61 on the opposite cylindrical body side. In the hanging scaffold 1 configured as described above, even if the pair of one-end-side attachment pieces 53 and 53 are bridged between the upper beam material 50 and the lower beam material 51 in this manner, when the beam member 5 is tilted to the back side and the plate 61 is fitted between the one-end-side attachment pieces 53 and 53, the lower beam material 51 of the beam member 5 does not interfere with the plate 61, and the plate 61 can be smoothly inserted between the one-end-side attachment pieces 53 and 53.

In addition, in order to avoid interference of the lower beam material 51 of the beam member 5 with the plate 61, as compared with a case where the length of the plate 61 in the vertical direction is shortened or the interval between the upper beam material 50 and the lower beam material 51 in the vertical direction is increased, in a case where the relief portion 61*a*2 is formed by cutting out the lower side of the plate 61 on the opposite cylindrical body side, it is not necessary to change the length of the plate 61 in the vertical direction or the interval between the upper beam material 50 and the lower beam material 51 in the vertical direction. Therefore, it is possible to avoid an increase in the weight of the beam member 5 while preventing a decrease in the strength of the plate 61.

In the present embodiment, the relief portion 61*a*2 is formed by obliquely cutting out the plate main body 61*a* of the plate 61, but the cutout shape is not particularly limited, and may be formed by cutting out the plate main body 61*a* of the plate 61 in an R-shape or a C-shape, for example. However, when the relief portion 61*a*2 is formed by obliquely cutting out the plate main body 61*a*, processing is easy as compared with a case of being formed by cutting out the plate main body 61*a* in an R-shape, and an area where the plate main body 61*a* is cut out is reduced as compared with a case of being formed by cutting out the plate main body 61*a* in a C-shape, so that a decrease in strength of the plate 61 can be suppressed.

In the hanging scaffold 1 of the present embodiment, the beam member 5 includes the lower beam material 51 arranged side by side below the upper beam material 50 and extending in parallel with the upper beam material 50, and the sides of the pair of the other-end-side attachment pieces (attachment pieces) 54 and 54 are connected to the other end portion (end portion) of the lower beam material 51. In the hanging scaffold 1 configured as described above, in a state where the other end of the beam member 5 is inserted into the recessed portion 61*c* of the plate 61 in a posture along the vertical direction, when the beam member 5 is tilted toward the back side and the plate 61 is fitted between the other-end-side attachment pieces 54 and 54, the lower beam material 51 does not interfere with the plate 61 even if the relief portion 61*a*2 is not provided in the plate 61. Therefore, since processing of providing the relief portion 61*a*2 in the plate 61 is not necessary, it is possible to suppress a decrease in the area of the plate 61 and to prevent a decrease in the strength of the plate 61.

In the hanging scaffold 1 configured as described above, since the sides of the pair of other-end-side attachment pieces 54 and 54 are connected to the other end portion of the lower beam material 51, the lower side of the gap between the other-end-side attachment pieces 54 and 54 is open. Therefore, from a state in which the upper beam material 50 of the beam member 5 is inserted into the recessed portion 61*c* of the plate 61 of the joint 6 of one scaffold body 10 of the two existing scaffold bodies 10 and 10 in a posture along the vertical direction erected with one end of the upper beam material 50 facing downward, the other end of the upper beam material 50 is tilted toward the other scaffold body 10, and the upper beam material 50 of the beam member 5 is brought into contact with the upper end of the plate 61 of the joint 6 of the other scaffold body 10 so as to cover from above, whereby the plate 61 can be fitted between the other-end-side attachment pieces 54 and 54. Then, in a state where the plate 61 is fitted between the other-end-side attachment pieces 54 and 54, the end portions of the beam members 5 are connected to the joints 6 via the coupling pins 7 from the work floors 3 of both the scaffold bodies 10 and 10, whereby the beam members 5 can be bridged and connected between the joint 6 of one scaffold body 10 and the joint 6 of the other scaffold body 10.

Therefore, in the hanging scaffold 1 configured as described above, the two scaffold bodies 10 and 10 are assembled simultaneously in the air, and the beam member 5 is bridged between the joints 6 and 6 of the two scaffold bodies 10 and 10 facing each other, whereby one hanging scaffold 1 can be assembled by connecting the two scaffold bodies 10 and 10 in the air, so that the hanging scaffold 1 having a large floor board area can be assembled in a short time.

In the present embodiment, the lower side of the gap between the one-end-side attachment pieces 53 and 53 provided on one end side of the beam member 5 is closed, and the lower side of the gap between the other-end-side attachment pieces 54 and 54 is opened. However, the lower side of the gap between the one-end-side attachment pieces 53 and 53 may be opened, and the lower side of the gap between the other-end-side attachment pieces 54 and 54 may be closed by the lower beam material 51. Alternatively, the lower side of both the gap between the one-end-side attachment pieces 53 and 53 and the gap between the other-end-side attachment pieces 54 and 54 may be opened or closed.

In addition, the lower beam material 51 may be omitted as long as the strength against the load of the scaffold body 10 is not insufficient.

In the hanging scaffold 1 of the present embodiment, the plurality of pin holes 53*a* and 54*a* are formed in the attachment pieces 53 and 54, the plurality of the insertion holes 61*a*1 are formed in the plate 61, and the coupling pin 7 has pin portions 70 as many as the pin holes 53*a* and 54*a* and the insertion holes 61*a*1 facing each other with the plate 61 fitted between the attachment pieces 53, 53, 54, and 54, and arranged at the same interval, and the connecting portion (the grip portion 71 or the regulating portion 72) that connects the pin portions 70.

In the hanging scaffold 1 configured as described above, since the attachment pieces 53, 53, 54, and 54 of the beam member 5 and the plate 61 of the joint 6 are connected at a plurality of locations, rotation of the beam member 5 with respect to the plate 61 in the vertical direction is regulated, and rattling of the beam member 5 in the vertical direction is suppressed.

Furthermore, since the coupling pin 7 has the same number of pin portions 70 as the number of pin holes 53*a* and 54*a* and the number of insertion holes 61*a*1, the pin portions 70 and 70 can be inserted into the plurality of pin holes 53*a* and 54*a* and the insertion holes 61*a*1 provided in the attachment pieces 53 and 54 and the plate 61 at one time, so that efficiency of operation of connecting the beam member 5 to the joint 6 is improved as compared with a case where pins are inserted into the plurality of pin holes 53*a* and 54*a* and insertion holes 61*a*1 one by one.

Note that the number of the pin holes 53*a*, 53*a*, 54*a*, and 54*a*, the number of the insertion holes 61*a*1, and the number of the pin portions 70 of the coupling pin 7 may be three or more. Even in this case, since the attachment pieces 53 and 54 and the plate 61 are connected at a plurality of locations, rattling of the beam member 5 in the vertical direction can be suppressed. However, the number of pin holes 53*a* and 54*a* of the attachment pieces 53 and 54 and the number of insertion holes 61*a*1 of the plate 61 may be one. In this case, the coupling pin may be one independent pin.

In the present embodiment, the coupling pin 7 includes the grip portion 71 and the regulating portion 72 as the connecting portion that connects the pin portions 70, but either one may be omitted. Alternatively, the coupling pin 7 may be a plurality of independent pins, and the pins may be inserted one at a time into the pin holes 53*a* and 54*a* and the insertion holes 61*a*1.

In addition, a method for assembling the hanging scaffold 1 of the present embodiment is a method for assembling a hanging scaffold, which includes the scaffold body 10 including the plurality of beam members 5 arranged in parallel, the joint 6 connected to end portions of the beam members 5 by a connecting member, and the work floor 3 installed between the beam members 5 and 5; and the chain 4 that suspends the scaffold body 10, in which the beam member 5 includes: the upper beam material 50; and the pairs of attachment pieces 53, 53, 54, and 54 provided at lower ends of the respective end portions of the upper beam material 50, arranged side by side in a horizontal direction when viewed from an axial direction, and formed with pin holes 53*a* and 54*a* facing each other, the joint 6 includes: the cylindrical body 60 having an axis along a vertical direction; and the plurality of plates 61 arranged at predetermined intervals in a circumferential direction on the outer periphery of the cylindrical body 60, and fittable between the attachment pieces 53, 53, 54, and 54 along the axial direction of the cylindrical body 60, and the plate 61 includes: the recessed portion 61*c* formed at an upper portion; and the insertion hole 61*a*1 facing the pin holes 53*a* and 54*a* of the attachment pieces 53, 53, 54, and 54 in a state of being fitted between the attachment pieces 53, 53, 54, and 54, and the connecting member is the coupling pin 7 inserted into the pin holes 53*a* and 54*a* and the insertion holes 61*a*1 facing each other in a state where the plate 61 is fitted between the attachment pieces 53, 53, 54, and 54, the method includes a step of inserting one end of the upper beam material 50 into the recessed portion 61*c* in a posture along the vertical direction; a step of rotating and folding the other end of the upper beam material 50 to a back side in a state where one end of the upper beam material 50 is inserted into the recessed portion 61*c*, and fitting the plate 61 between the one-end-side attachment pieces 53 and 53 on one end side of the upper beam material 50; and a step of inserting the coupling pin 7 into the pin holes 53*a* of the one-end-side attachment pieces 53 and 53 and the insertion holes 61*a*1 of the plate 61 facing each other.

According to such a method for assembling the hanging scaffold 1, in the step of inserting one end of the upper beam material 50 into the recessed portion 61*c* in a posture along the vertical direction, the step of rotating and folding the other end of the upper beam material 50 to the back side in a state where the one end of the upper beam material 50 is inserted into the recessed portion 61*c*, and fitting the plate 61 between the one-end-side attachment pieces 53 and 53 on the one end side of the upper beam material 50, and the step of inserting the coupling pin 7 into the pin holes 53*a* and 53*a* of the one-end-side attachment pieces 53 and 53 and the insertion holes 61*a*1 of the plate 61 facing each other, the worker does not need to bend over the work floor 3 of the scaffold body 10 suspended and supported by a building, a construction, or the like. Therefore, according to such a method for assembling the hanging scaffold 1 of the present embodiment, it is possible to safely perform an operation of connecting the beam member 5 to the joint 6 of the scaffold body 10 while configuring the beam member 5 compactly.

In addition, when one end of the upper beam material 50 is inserted into the recessed portion 61*c*, one end of the upper beam material 50 can be supported by the joint 6 when the beam member 5 is tilted toward the back side.

Therefore, when the beam member 5 is tilted toward the back side, one end of the beam member 5 is supported by the joint 6, so that the beam member 5 can be safely tilted toward the back side, and the operation of connecting the beam member 5 to the joint 6 of the scaffold body 10 can be safely and easily performed.

Furthermore, when the beam member 5 is tilted toward the back side, one end of the upper beam material 50 enters the recessed portion 61*c* and is supported until the beam member 5 takes a horizontal posture, and thus, it is possible to prevent one end of the upper beam material 50 from sliding on the upper surface of the plate 61 and moving, and it is possible to safely and easily perform the operation of connecting the beam member 5 to the joint 6 of the scaffold body 10.

Although the preferred embodiments of the present invention have been described in detail above, it is obvious that modifications, variations, and changes can be made without departing from the scope of the claims.

What is claimed is:

1. A hanging scaffold comprising:

a scaffold body including a plurality of beam members arranged in parallel, a joint connected to end portions of the beam members by a connecting member, and a work floor installed between the beam members; and a hanging member that suspends the scaffold body, wherein the beam member includes: a beam material; and a pair of attachment pieces provided at respective lower sides of each end portion of the beam material, arranged side by side in a horizontal direction when viewed from an axial direction, and formed with pin holes facing each other, the joint includes: a cylindrical body having an axis along a vertical direction; and a plurality of plates arranged at predetermined intervals in a circumferential direction on an outer periphery of the cylindrical body, and fittable between the attachment pieces along the axial direction of the cylindrical body, the plate includes: a recessed portion formed at an upper side of the plate, the upper side being orthogonal to the vertical direction; a protruding portion forming an opposite cylindrical body-side side wall of the recessed portion; and an insertion hole facing the pin hole of the attachment piece in a state of being fitted between the attachment pieces, the connecting member is a coupling pin inserted into the pin hole and the insertion hole facing each other in a state where the plate is fitted between the attachment pieces, the beam material has a corner on a lower side of one end of the beam material, the lower side being orthogonal to the vertical direction, the corner being on a distal end of the beam material furthest from another end of the beam material, a width of the recessed portion along an extending direction of the plate from the cylindrical body is large enough to permit insertion of the corner of the beam material, the extending direction being orthogonal to the vertical direction, and a recessed portion-side upper end of the protruding portion functions as a fulcrum for rotation of the beam material to the opposite cylindrical body side in a state where the corner is inserted into the recessed portion.

2. The hanging scaffold according to claim 1, wherein an upper end of the plate is positioned below an upper end of the cylindrical body.

3. The hanging scaffold according to claim 1, wherein the beam member includes lower beam materials arranged side by side below the beam material and extending in parallel with the beam material, and the pair of attachment pieces are vertically bridged between the beam material and the lower beam material.

4. The hanging scaffold according to claim 3, wherein the plate includes a relief portion formed by cutting out a lower side of the plate on an opposite cylindrical body side.

5. The hanging scaffold according to claim 1, wherein the beam member includes lower beam materials arranged side by side below the beam material and extending in parallel with the beam material, and sides of the pair of attachment pieces are connected to end portions of the lower beam materials.

6. The hanging scaffold according to claim 1, wherein a plurality of the pin holes are formed in the attachment piece and a plurality of the insertion holes are formed in the plate, and the coupling pin includes pin portions as many as the pin holes and the insertion holes facing each other with the plate fitted between the attachment pieces and arranged at the same interval, and a connecting portion that connects the pin portions.

7. The hanging scaffold according to claim 1, wherein the lower sides of each end portion of the beam material are orthogonal to the vertical direction.

8. A hanging scaffold comprising:

a scaffold body including a plurality of beam members arranged in parallel, a joint connected to end portions of the beam members by a connecting member, and a work floor installed between the beam members; and a hanging member that suspends the scaffold body, wherein the beam member includes: a beam material; and a pair of attachment pieces provided at respective lower sides of each end portion of the beam material, arranged side by side in a horizontal direction when viewed from an axial direction, and formed with pin holes facing each other, the joint includes: a cylindrical body having an axis along a vertical direction; and a plurality of plates arranged at predetermined intervals in a circumferential direction on an outer periphery of the cylindrical body, and fittable between the attachment pieces along the axial direction of the cylindrical body, the plate includes: a recessed portion formed at an upper side of the plate, the upper side being orthogonal to the vertical direction; and an insertion hole facing the pin hole of the attachment piece in a state of being fitted between the attachment pieces, the connecting member is a coupling pin inserted into the pin hole and the insertion hole facing each other in a state where the plate is fitted between the attachment pieces, and a width of the recessed portion along an extending direction of the plate from the cylindrical body is larger than a height of the beam material in the vertical direction, the extending direction being orthogonal to the vertical direction.

9. A method for assembling a hanging scaffold comprising:

a scaffold body including a plurality of beam members arranged in parallel, a joint connected to end portions of the beam members by a connecting member, and a work floor installed between the beam members; and a hanging member that suspends the scaffold body, wherein the beam member includes: a beam material; and a pair of attachment pieces provided at respective lower sides of each end portion of the beam material, arranged side by side in a horizontal direction when viewed from an axial direction, and formed with pin holes facing each other, the joint includes: a cylindrical body having an axis along a vertical direction; and a plurality of plates arranged at predetermined intervals in a circumferential direction on an outer periphery of the cylindrical body, and fittable between the attachment pieces along the axial direction of the cylindrical body, the plate includes: a recessed portion formed at an upper side of the plate, the upper side being orthogonal to the vertical direction; and an insertion hole facing the pin hole of the attachment piece in a state of being fitted between the attachment pieces, and the connecting member is a coupling pin inserted into the pin hole and the insertion hole facing each other in a state where the plate is fitted between the attachment pieces, the method comprising:

a step of inserting one end of the beam material into the recessed portion in a posture along the vertical direction;

a step of rotating and folding an other end of the beam material to a back side in a state where the one end of the beam material is inserted into the recessed portion, and fitting the plate between the attachment pieces on one end side of the beam material; and a step of inserting the coupling pin into the pin hole of the attachment piece and the insertion hole of the plate facing each other.

* * * * *